US008474187B2

(12) United States Patent
Marocco

(10) Patent No.: US 8,474,187 B2
(45) Date of Patent: Jul. 2, 2013

(54) SHUTTER WITH REMOVABLE LOUVRES

(75) Inventor: Mario M. Marocco, Toronto (CA)

(73) Assignee: Maxxmar Inc., Toronto, Ontario (CA)

( * ) Notice: Subject to any disclaimer, the term of this patent is extended or adjusted under 35 U.S.C. 154(b) by 140 days.

(21) Appl. No.: 12/805,738

(22) Filed: Aug. 18, 2010

(65) Prior Publication Data

US 2012/0042570 A1 Feb. 23, 2012

(51) Int. Cl.
*E06B 7/00* (2006.01)

(52) U.S. Cl.
USPC ..... 49/403; 49/74.1

(58) Field of Classification Search
USPC ..... 49/74.1, 77.1, 90.1, 92.1, 403, 463, 49/464, 465
See application file for complete search history.

(56) References Cited

U.S. PATENT DOCUMENTS

| | | | | | |
|---|---|---|---|---|---|
| 390,392 | A * | 10/1888 | Niss | 160/175 |
| 702,148 | A * | 6/1902 | Nettleton | 49/403 |
| 2,146,142 | A * | 2/1939 | Heasley | 126/285 R |
| 4,744,290 | A * | 5/1988 | Josephson | 454/333 |
| 5,191,735 | A * | 3/1993 | Ross | 49/74.1 |
| 5,216,837 | A * | 6/1993 | Cleaver et al. | 49/82.1 |
| 5,339,591 | A * | 8/1994 | Underdahl | 52/473 |
| 5,347,756 | A * | 9/1994 | Abbott et al. | 49/74.1 |
| 5,887,386 | A * | 3/1999 | Alexanian et al. | 49/403 |
| 5,921,028 | A * | 7/1999 | Marocco | 49/403 |
| 6,536,162 | B2 * | 3/2003 | LaMay | 49/403 |
| 6,595,379 | B1 * | 7/2003 | Powell | 211/192 |
| 6,675,534 | B2 * | 1/2004 | Marocco | 49/86.1 |
| 7,124,537 | B2 * | 10/2006 | Young | 49/74.1 |
| 7,921,602 | B2 * | 4/2011 | Ohanesian | 49/403 |
| 2003/0159355 | A1 * | 8/2003 | Froerer et al. | 49/74.1 |
| 2004/0031233 | A1 * | 2/2004 | Cope et al. | 52/769 |
| 2004/0045220 | A1 * | 3/2004 | Fraser et al. | 49/74.1 |
| 2006/0288644 | A1 * | 12/2006 | Vasquez | 49/74.1 |
| 2007/0101651 | A1 * | 5/2007 | Nien | 49/92.1 |
| 2007/0157519 | A1 * | 7/2007 | Nien et al. | 49/74.1 |
| 2008/0092444 | A1 * | 4/2008 | Yang | 49/92.1 |
| 2008/0295406 | A1 * | 12/2008 | Kollman et al. | 49/74.1 |
| 2009/0077894 | A1 * | 3/2009 | King et al. | 49/92.1 |
| 2009/0078378 | A1 * | 3/2009 | Cecchetti et al. | 160/166.1 |
| 2009/0113798 | A1 * | 5/2009 | Nieves Zeno | 49/92.1 |
| 2010/0122492 | A1 * | 5/2010 | Morris et al. | 49/89.1 |
| 2010/0175325 | A1 * | 7/2010 | Chen | 49/90.1 |
| 2010/0243809 | A1 * | 9/2010 | Noble et al. | 244/129.4 |
| 2011/0126464 | A1 * | 6/2011 | Stone et al. | 49/82.1 |
| 2011/0214348 | A1 * | 9/2011 | Park | 49/90.1 |
| 2011/0219692 | A1 * | 9/2011 | Ohanesian | 49/77.1 |

* cited by examiner

*Primary Examiner* — Jerry Redman

(57) ABSTRACT

A shutter having a frame, and louvres and having a control mechanism for operating all louvres, louvre drive couplings in each louvre, at least one moveable drive connector member for connecting between each louvre drive coupling, the drive connector member being moveable between engaged and disengaged positions, and having biasing springs for the drive connectors, yieldable to permit movement of the drive connectors out of the engaged positions.

6 Claims, 5 Drawing Sheets

SHUTTER WITH REMOVABLE LOUVRES

FIELD OF THE INVENTION

The invention relates to shutters of the type having a frame, and louvres rotatable in the frame, and a control system connected to the louvres, for rotating them open and closed, and having louvres which are individually removable from the frame for servicing.

BACKGROUND OF THE INVENTION

Shutters for windows and doors usually have a frame, mounted in the window or door opening, and rotatable louvres extending across the frame, from side to side. A control system is connected to the louvres. Moving the control system rotates all the louvres. In this way the louvres can be tilted open for light and air, or tilted up or down and closed for privacy.

Shutters have been made in this general pattern for hundreds of years. Where it is required to provide shutters for large, or high windows, or for example in institutions, or commercial or public buildings, or auditoriums and the like, additional features should preferably be provided.

The control system will preferably be concealed within the side of the frame.

The control system may be power operated, possibly with automatic sensors responding to sunshine, or changes in weather, time of day, internal temperature and the like.

The individual louvres should be capable of being removed and replaced, for servicing, or cleaning, without requiring major dismantling of the shutter.

This removable feature can be a problem. Each louvre is usually provided with axles or pivots at each end, by which it is mounted in the frame. The control system connects with each louvre, usually through one of the axles, so that operation of the control system will rotate all louvres in unison.

To render the louvres individually removable, the connection between the control system and each louvre is releasable. The louvres themselves are removable individually from the frame so that they can be dismantled and taken away for cleaning or replacement, without disturbing the frame itself or the rest of the louvre.

BRIEF SUMMARY OF THE INVENTION

In order to achieve at least some of these features, the invention provides a shutter of the type having a frame, and louvres extending from side to side within the frame, the louvres being rotatable about parallel axes and there being louvre axles for each end of each louvre, and comprising; a control mechanism within at least one side of the frame for operating all louvres; control drive members in said control mechanism for engaging respective said louvres; louvre drive couplings in each said louvre for coupling a louvre to its respective said control drive member; at least one moveable drive connector for connecting between at least one of said control drive members and at least one of said louvre drive couplings for each said louvre, said moveable drive connector being moveable between engaged and disengaged positions to release said louvre from said control drive member; respective biasing devices urging respective said drive connectors into said engaged positions and said biasing device being yieldable to permit movement of said drive connectors out of said engaged positions. Preferably there are respective drive socket members in respective said control drive members, and drive connector devices being slidable within said socket relative to respective said louvre drive couplings. A control button on said connector and a slot opening in said coupling.

Preferably the drive socket members have drive surfaces, and said drive connectors have complementary drive faces.

Preferably a locking member is engageable with said drive connector, operable to hold said drive connector is its disengaged position.

Preferably said drive sockets in said control drive members are of generally non circular interior shape, and said louvre drive couplings comprise elongated sockets of rectangular interior shape mounted in respective said louvres.

Preferably said control mechanism includes respective louvre drive members for respective said louvres, each of said louvre drive members having a rotatable body portion, and at least one lever arm extending outwardly from said body portion operable to rotate said body portion.

Preferably there is control linkage extending between respective said lever arms operable to cause operation of all said lever arms and said body portions simultaneously.

The control mechanism may include any suitable form of safety clutch. (not shown) to avoid damage in the event of errors in operation.

According to a further embodiment it is possible to employ the same design for releasing individual louvres, while avoiding the formation of slotted openings in the louvres themselves.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
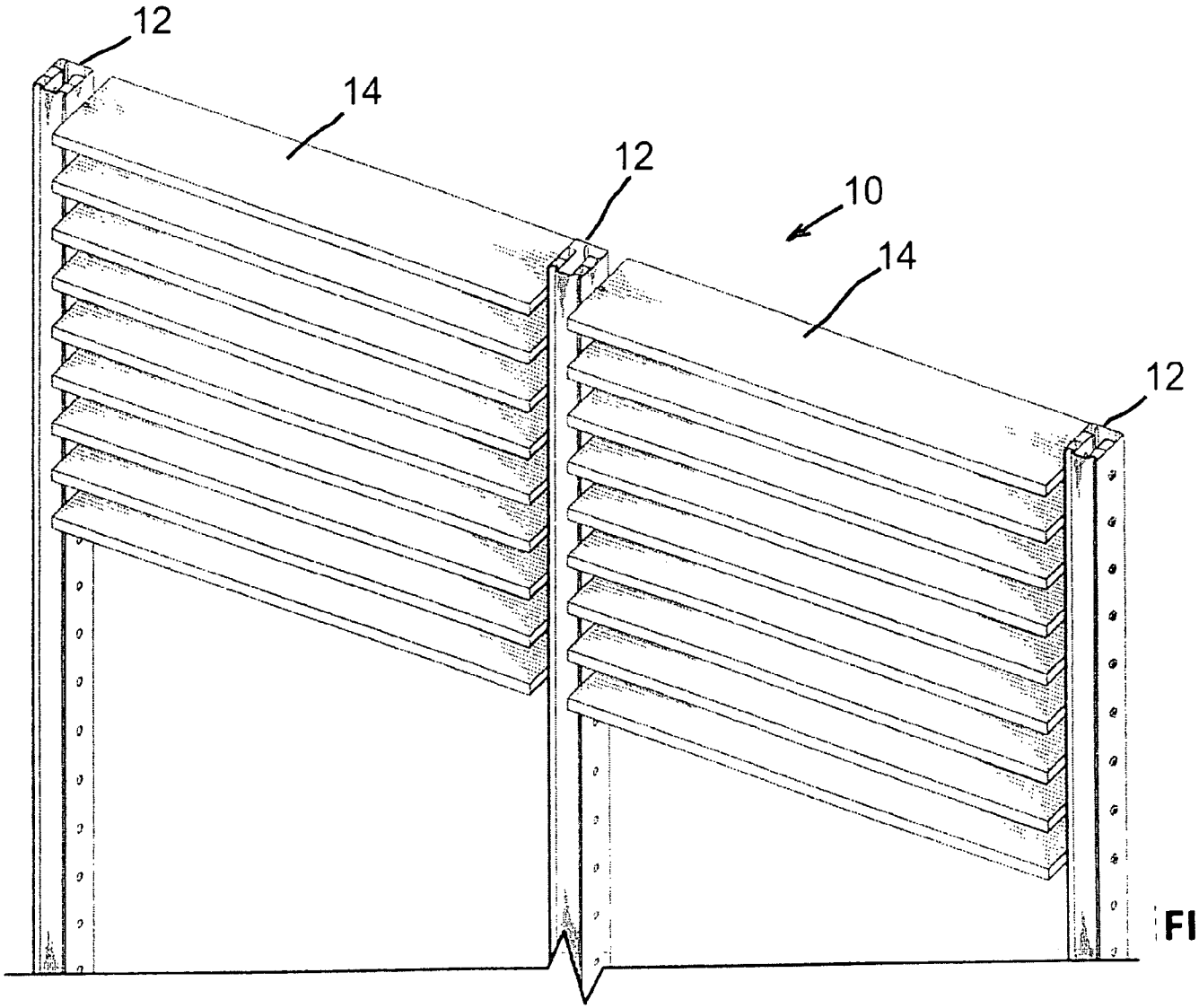
FIG. 1 is a perspective on a portion of a shutter illustrating the invention.
Figure 2:
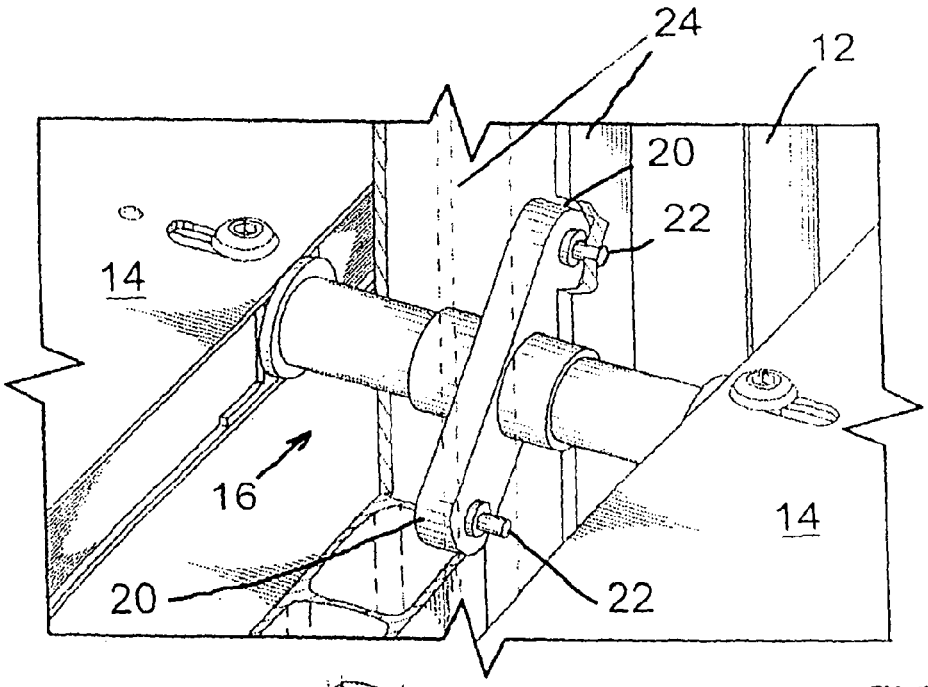
FIG. 2 is a perspective illustration showing a drive coupling member, coupled with two louvres, and showing a control mechanism, partly in phantom.
Figure 3:
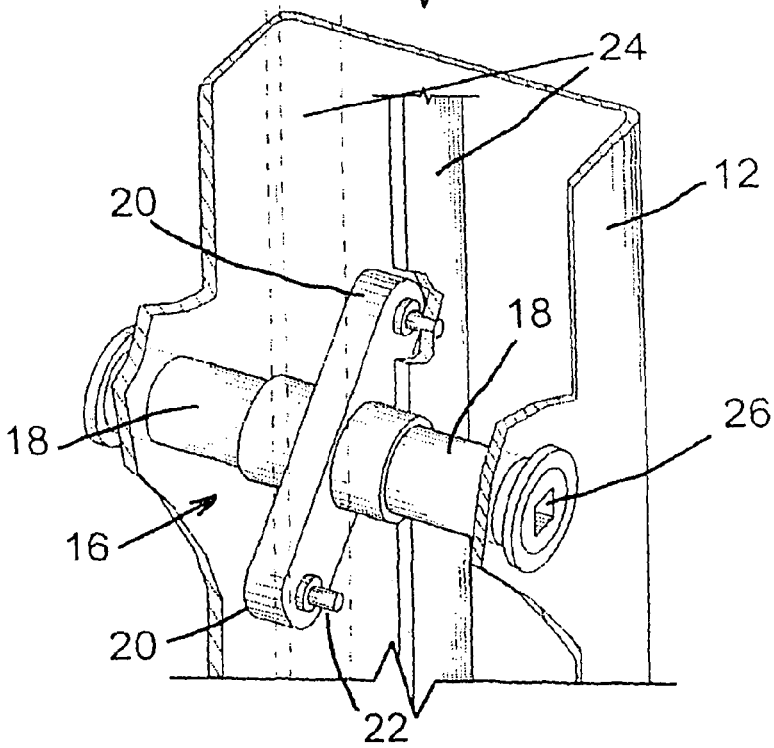
FIG. 3 is a perspective illustration showing the shutter frame and control mechanism partly in phantom and a drive coupling member, within the frame but without louvres coupled thereto.

Referring to FIG. 1 it will be seen that this illustrates an embodiment of the invention, in the form of a shutter (10) having a frame with side members (12). The frame will also have top and bottom members (not shown) in most cases.

Louvres (14) extend from side to side of the frame, at spaced intervals. As is well known such louvres (14) are rotatable between open and closed positions. In simple domestic shutters the louvres are permanently installed in their frames. Cleaning or servicing of such simpler shutters does not present any major problem. However, in the case of larger shutter installations, such as in public spaces, institutions, commercial space and the like, the shutters are usually larger and may extend up to a height of two or three stories high. The windows may be wider than in domestic situations, requiring shutters with longer louvres than usual. As a result the entire shutter system must be made heavier, and stronger, than is usual for domestic shutters. The louvres (14) are preferably power operated, possibly controlled by some form of automatic sensor. Cleaning and servicing, and of course installation of such shutters becomes a more arduous task. In order to make this work easier the louvres (14) are made so that they are individually removeable, and replaceable. As is best shown in FIGS. 2, 3, 4 and 5 the shutter (10) has side frames (12) which are four sided hollow metal channels, in this case. Top and bottom frames (not shown) would normally be provided, and made from the same channel.

Louvres (14) are supported between the two side frames (12)

Within the hollow side frames (12) there are located a plurality of control drive assemblies (16). The control drive assemblies comprise generally a single, or a pair of sleeves (18), (which in this case are of generally cylindrical shape), and two drive levers (20), extending outwardly on opposite sides, normal to the axis of the control drive assemblies (16).

The drive levers (20) have drive pins (22). Control operating rods (24) extend lengthwise up the hollow side frames and connect with each of the drive pins (22), on respective drive levers (20).

There are two such control operating rods (24), one for one of the drive levers (20) on each control drive assembly (16) and the other for the other drive levers (20) of each such control drive assembly (16), one control operating rod (24) being shown in phantom.

Movement of one control operating rod (24) upwards, will be matched by corresponding movement of the other of the control operating rods (24) downwards. In this way a smooth positive rotation of each of the control drive assemblies (16) is assured.

A power drive mechanism (not shown) may be provided which connects with the control operating rods. Alternatively operation of the control operating rods may be a manual system, by any suitable means (not shown).

Operation of the control operating rods (24), in opposite directions, as described above, will cause rotation of control drive assemblies (16)

It will be appreciated that within the cylindrical sleeves (18) there are formed generally rectangular shaped drive socket members (26). Preferably these are formed of moulded plastic for simplicity, held within the cylindrical sleeves (18)

The louvres (14) are provided with louvre drive couplings (28) which are essentially rectangular shaped sockets, held in the ends of the louvres (14).

Respective drive connector members (30) of rectangular cross section, and defined by rectangular shaped bars, are located within each of said louvre drive couplings (28).

The drive connector members (30) make a snug sliding fit in both the drive socket members (26) and in the louvre drive couplings (28). In this way the drive connector members (30) communicate the rotational drive from the control drive assemblies (16) to each of louvres (14).

Figure 5:
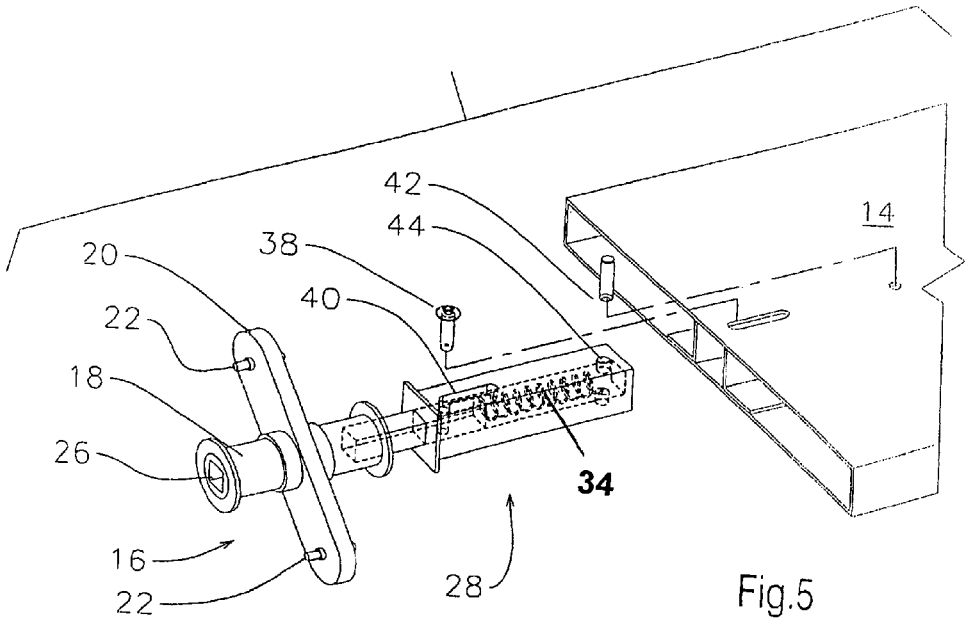
FIG. 5 is an exploded perspective illustration corresponding to FIG. 4 but showing the coupling member separated from the drive coupling.

In order to permit removal and replacement of a louvre (14), the drive connector member (30) has a connector extension (32), slidable within louvre drive coupling (28), and a compression spring (34) shown in phantom in FIG. 5,.

Figure 4:
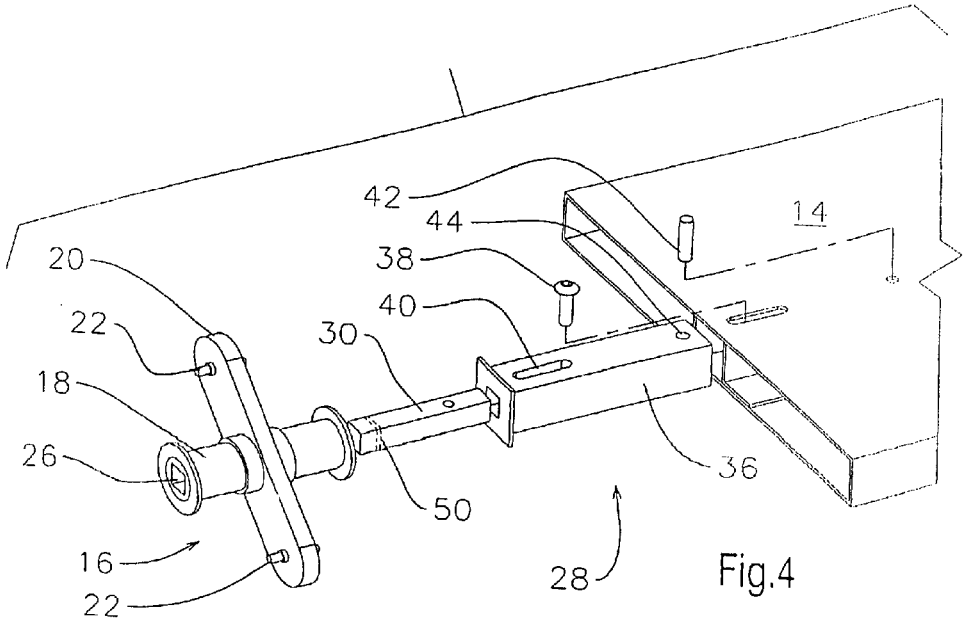
FIG. 4 is an exploded perspective illustration showing a drive coupling member, and a drive coupling and a portion of a louvre.

The compression spring (34) (in phantom) is captive within the interior of coupling body ((36) FIG. 4, of the louvre drive coupling (28). In this way the compression spring (34) biasses the drive connector member (30) outwardly from the louvre drive coupling (28), into the drive socket member (26) of the respective control drive assembly (16).

In order to release the drive connector member (30) from engagement in the drive socket member (26), to permit removal of an individual louvre (14), the drive connector member (30) has a manually engageable operating device, which in this case comprises a knob (38), extending out from a slot (40) in the louvre drive couplings (28). This knob (38) can be operated by a thumb or finger, to slide the drive connector member (30) against the compression spring (34).

The drive connector member (30) can be manually locked in this disengaged position by means of a manually operable lock button (42) which engages in recess (44) in the drive connector member (30). This holds the drive connector member (30) in its withdrawn position, out of drive socket member (26) of control drive member (16).

The same operation can be done at the opposite end of the louvre (14), if desired, although in many cases the disengagement of the drive connector member (30) at one end of the louvre (14) will be enough to permit the louvre (14) to be removed.

In order to replace the louvre (14), the louvre (14) is placed in position. If both drive connector members (30), of the one louvre have been retracted, then the operator simply releases the lock button at one end of the louvre, and then releases the button at the other end of the louvre. This permits the compression spring (34) to advance the drive connector member (30) outwardly, into the respective drive socket member (26) of the respective control drive assembly (16), for reinstallation of the louvre (14), in the shutter.

The control operating mechanism may be located in both side frames to support both ends of each louvre.

The control drive assemblies (16) and the control operating rods (24) would be provided in both side frames to provide rotatable support for each end of each louvre.

But if desired, they may be located in only one side frame, in which case some form of bearings (not shown) similar to rotatable sleeves (18) (or equivalent) would be provided in the other side frame, to provide rotatable support for each louvre.

If desired, for safety of operation, a simple clutch (50) (FIG. 4) can be incorporated in for example drive connector (30). The clutch would provide for slippage, in the event of over rotation of the control mechanism, and thereby prevent damage.

According to a further embodiment it is possible to employ a similar design for releasing individual louvres, while avoiding the formation of slotted openings in the louvres themselves. This is particularly advantageous when using for example wooden louvres, where the wood is solid. It can also be helpful when using hollow louvres made of metal or plastic, since it avoids numerous additional fabrication steps.

Figure 6:
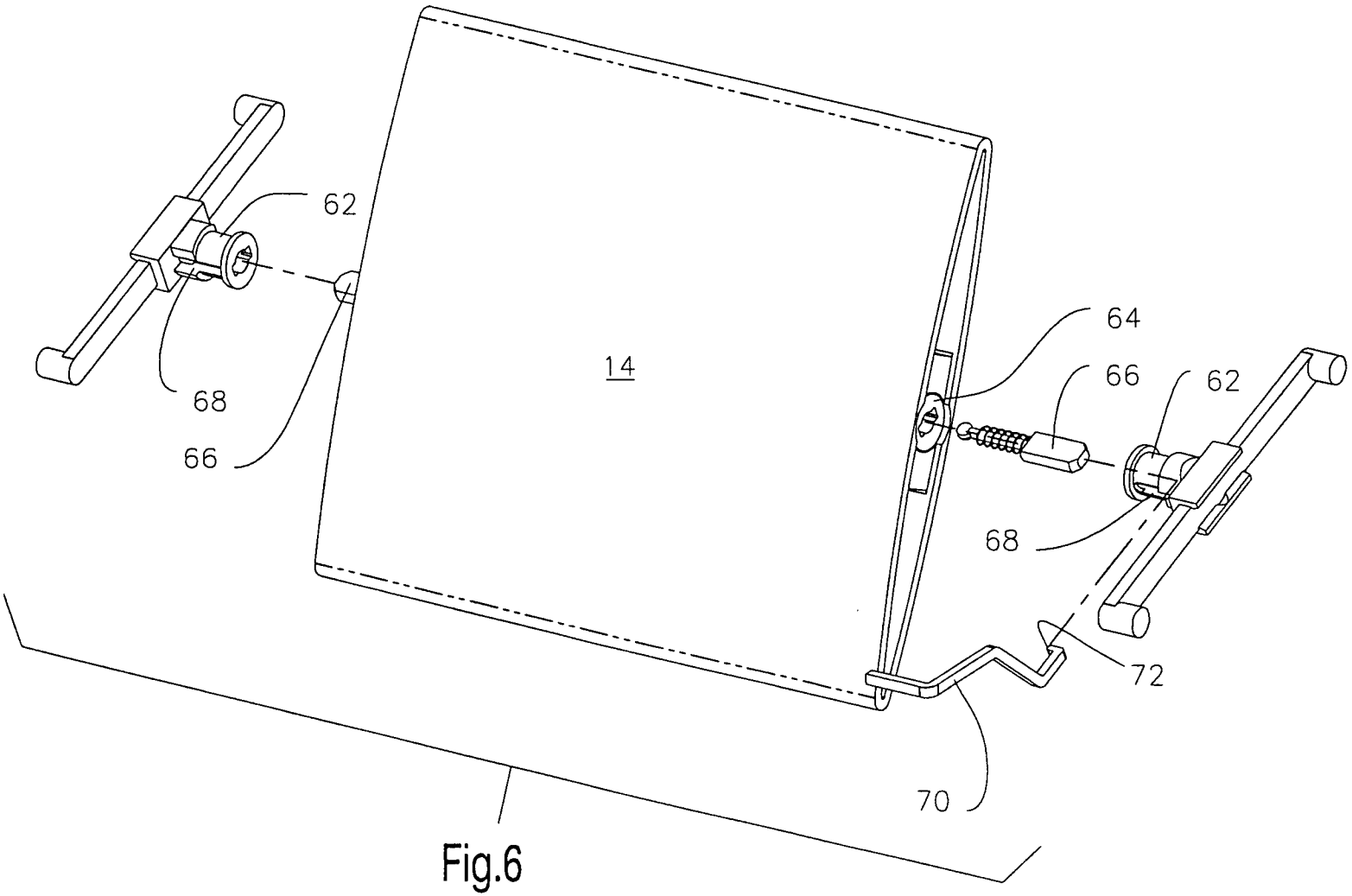
FIG. 6 is an exploded perspective of another embodiment.
Figure 7:
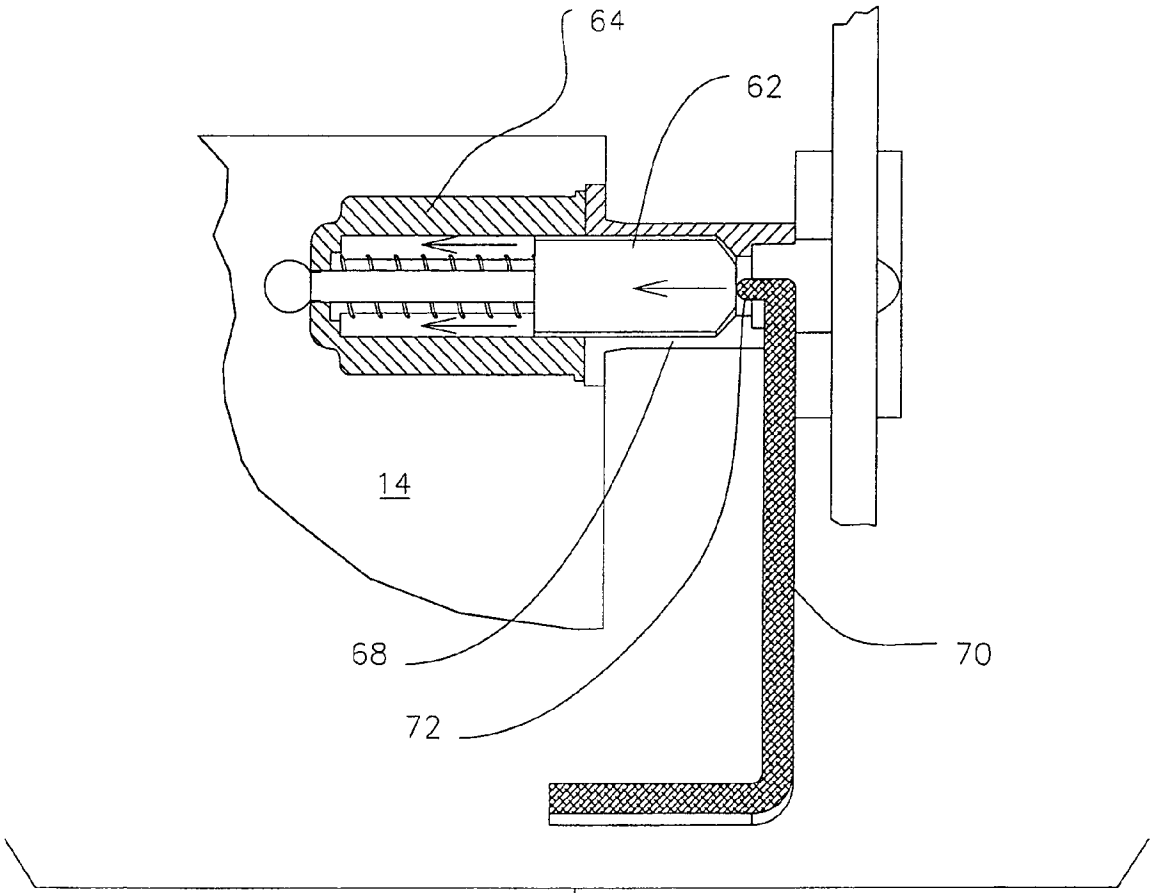
FIG. 7 is a section along 7-7 of FIG. 6.

This further embodiment is illustrated in FIGS. 6, and 7.

In this embodiment the louvres (14) are connected to respective drive hubs (62) at each end of each louvre, as before.

This connection is achieved, in this embodiment, by means of a driven sleeve (64) secured in one, or preferably both, ends of each louvre. Sleeve (64) may be typically an injection moulding, and is embedded in and secured along the central axis of the louvre. Sleeve (64) has a generally cylindrical body, sized to fit between the opposite side walls of a hollow louvre (14). Spring loaded connector members (66) connect the hubs to the sleeves.

Slots (68) are formed in hubs (62).

A tool (70) formed with an angular end (72) is made to fit within slots (68).

By inserting the end of the tool into a slot, the drive connector member may be slid back against the spring, thus releasing the louvre from the hub.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shutter having a frame, and a plurality of louvres extending from side to side within the frame, the louvres being rotatable about parallel axes and having a control mechanism within at least one side of the frame for operating all louvres and comprising;

a plurality of control drive assemblies in said control mechanism for engaging respective said louvres;

a louvre drive coupling in each of said plurality of louvres, for interengagement with respective said control drive assemblies comprising a socket of rectangular interior shape mounted in respective said louvre drive couplings;

a slot formed in a side of each said socket;

a moveable drive connector member slidably received in each said socket for connecting between each said louvre drive coupling and a respective said control drive assembly;

a manually engageable operating device coupled with each said drive connector member and extending outwardly from said slot in said socket and being manually operable to move said drive connector member between engaged and disengaged positions to release a respective said louvre from its respective said control drive assembly;

a respective biassing device in each said respective louvre drive coupling urging a respective said drive connector member into said engaged position and being yieldable to permit movement of said drive connector member out of said engaged position; and, a locking pin member in said socket and engageable with said drive connector member and operable to hold said drive connector member is its disengaged position.

2. The shutter as claimed in claim 1 and including respective drive socket members in respective said control drive assemblies, and respective said drive connectors being slideable relative to respective said drive socket members.

3. The shutter as claimed in claim 2 and including drive surfaces in each said drive socket member, and wherein said drive connector has drive faces complementary to said drive surfaces in said drive member.

4. A shutter as claimed in claim 2 and wherein said drive socket members in respective said control drive assemblies are of generally rectangular interior shape.

5. The shutter as claimed in claim 4 and wherein each of said control drive assemblies has a generally cylindrical rotatable body portion, and at least one lever arm extending outwardly from said body portion operable to rotate said body portion.

6. The shutter as claimed in claim 5 and including control operating rods extending between respective said lever arms of adjacent said control drive assemblies operable to cause operation of all said lever arms and all of said control drive assemblies simultaneously.

* * * * *